United States Patent [19]

Grantham

[11] 3,961,503

[45] June 8, 1976

[54] LAUNDERING APPARATUS AND METHOD, CONTINUOUS WITH RECIRCULATION

[76] Inventor: Frederick W. Grantham, 600 S. Lairport St., El Segundo, Calif. 90245

[22] Filed: Sept. 21, 1972

[21] Appl. No.: 290,862

Related U.S. Application Data

[63] Continuation-in-part of Ser. No. 16,318, March 4, 1970, Pat. No. 3,693,382.

[52] U.S. Cl. ..... 68/27; 68/9; 68/184

[51] Int. Cl.[2] ..... D06F 31/00

[58] Field of Search ..... 68/9, 27, 158, 184, 68/181 R

[56] References Cited

UNITED STATES PATENTS

| | | | |
|---|---|---|---|
| 663,452 | 12/1900 | Maertens | 68/184 X |
| 1,913,601 | 6/1933 | Leppin | 68/184 X |
| 2,674,113 | 4/1954 | Schrenk | 68/181 R X |
| 2,721,466 | 10/1955 | Nash | 68/181 R X |
| 2,745,712 | 5/1956 | Burling et al. | 68/27 X |
| 2,764,010 | 9/1956 | Williams | 68/27 |
| 2,782,623 | 2/1957 | Coe et al. | 68/181 R |
| 3,074,775 | 1/1963 | Oldershaw | 68/181 R X |

*Primary Examiner*—Philip R. Coe
*Attorney, Agent, or Firm*—Henry M. Bissell

[57] ABSTRACT

Laundering apparatus for washing, rinsing, etc., in which the water, with the laundry goods, is flowed through in a continuous operation. There may be a single unit, or a plurality of units in series. Means is provided for recirculating water from the exit end of a unit to the entrance end or from one unit to another unit in front of it.

6 Claims, 8 Drawing Figures

LAUNDERING APPARATUS AND METHOD, CONTINUOUS WITH RECIRCULATION

This application is a continuation-in-part of my prior and co-pending parent application, Ser. No. 16,318, filed Mar. 4, 1970 now U.S. Pat. No. 3,693,382.

CROSS REFERENCES

Applicant's co-pending application which is also a continuation-in-part of the above parent application:

Ser. No. 290,863 filed Sept. 21, 1972 for Laundry Dryer and Method, Continuous, now U.S. Pat. No. 3,843,221.

OBJECTS OF THE INVENTION:

The invention resides in the field of continuous laundering. The above mentioned parent application discloses and claims broadly a characteristic type of continuous laundry apparatus. The apparatus and method of that application are particularly adapted to such continuous laundering that will accommodate loose and detached pieces, as distinguished from moving a continuous long piece, such as a continuous towel, through a laundering unit. The continuous laundering there disclosed includes not only a single unit which accommodates continuous laundering, but a plurality of units arranged in series, and the continuous operation is related from one unit to the next throughout the series. The units may be utilized for specific steps such as washing, per se, rinsing, etc.

A broad object of the invention is to provide recirculation of water or washing fluid in a laundering operation.

Another and broad object is to provide recirculation of the character just referred to, that is particularly adaptable to a continuous laundering operation.

Still another object is to provide laundering and recirculation of the water or laundering fluid, particularly adapted to a plurality of units in which a continuous laundering operation is utilized in each unit and the continuous operation is related from one unit to the next.

DESCRIPTION OF A PREFERRED EMBODIMENT:

In the drawings.

In the following description of the apparatus the same reference numerals used in the parent application are used herein to identify the same elements.

Figure 1:
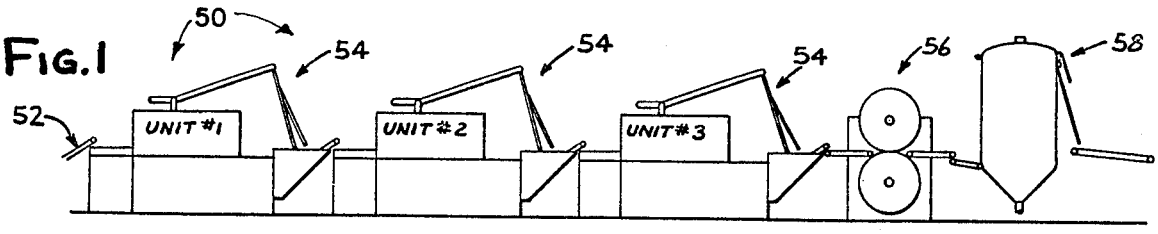
FIG. 1 is a side elevational view, of small scale and semi-diagrammatic in nature, of laundering apparatus to which the present invention is particularly adaptable, and which includes a plurality of laundering units in series arrangement.

Referring in detail to the drawings attention is directed first to FIG. 1 which shows in diagrammatic form an overall apparatus identified generally at 50, for performing a laundering operation, similar to the overall apparatus disclosed in the parent application. The apparatus includes as the major components or units thereof a plurality of washing units 54, in this case three, individually identified as No. 1, No. 2, No. 3; an entrance conveyor 52 may be utilized for introducing the laundry goods into the first unit; the apparatus also includes an extractor or extracting unit 56, and a dryer or drying unit 58. The washing units 54 may be identical to each other, and the specific construction thereof is described hereinbelow in connection with FIG. 2, but broadly in the overall operation the goods are introduced into the first unit by suitable means such as the conveyor 52, and the goods are processed in that unit, such as soaked, washed, etc. The goods are then removed from the first unit and introduced into the second unit where another processing step is performed, such as washing, rinsing, etc. Then the goods are removed from the second unit and introduced into the third unit where an additional processing step is performed, such as rinsing, alkali-ing. The extractor 56 and dryer 58 do not as such enter into the present invention, but it is pointed out that the dryer is covered by the above mentioned co-pending application Ser. No. 290,863.

Figure 2:
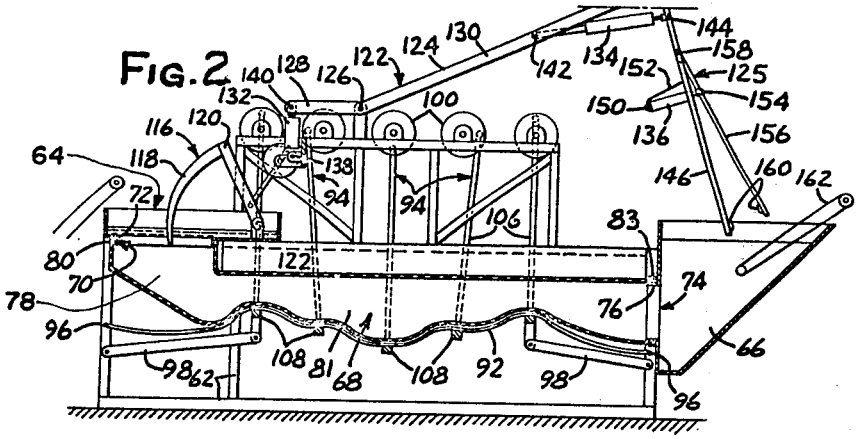
FIG. 2 is a longitudinal vertical sectional view of one form of laundering unit capable of producing continuous operation, and a form of apparatus to which the present invention is particularly adaptable.

Reference is next made to FIG. 2 showing the internal construction of one form of washing unit 54, and particularly one that utilizes continuous washing. The construction of this unit is disclosed and claimed in the parent application. The present invention involving recirculation is not limited to the specific form of washing unit disclosed in FIG. 2, but is adaptable to any of a wide variety of kinds of washing unit.

The washing unit 54 includes a peristaltic component which, as indicated above, is disclosed and claimed in the parent application in connection with laundry apparatus.

In FIG. 2, the washing unit 54 includes a suitable framework 62 having an entrance tank 64, an exit tank 66, and a flexible tube 68 connected therebetween. The tank 64 has a bottom opening 70 with a downwardly extending surrounding flange 72 and the exit tank 66 has a side opening 74 provided with a surrounding flange 76. The flexible tube 68 may be of rubber or rubber-like product, reinforced, for providing suitable strength but also sufficiently flexible for enabling the flexing movements in the washing unit and peristaltic movement of the goods. The tube may be pre-shaped, having an entrance end portion 78 encompassing the flange 72 to which it is secured by suitable means such as a band 80, a main section or body 81, and a terminal end portion 82 surrounding the flange 76 to which it is secured by a band 83.

Regardless of the form of washing unit utilized for showing the application of the present invention, the invention has particularly significant adaptation to continuous washing, and the specific form of FIG. 2 exemplifies such continuous washing. The flexible tube 68 receives the goods to be laundered from the entrance tank 64 and empties them into the exit tank 66. The tube and tanks form a container for containing the water and the laundry goods. In the recirculation operation, the water in one example is withdrawn from the exit tank 66 and reintroduced into the entrance tank 64 in a recirculation step. The recirculation may be related to only a single unit, or to adjacent units, as desired, withdrawing water from one unit and reintroducing it into a unit in front of it.

Figure 3:
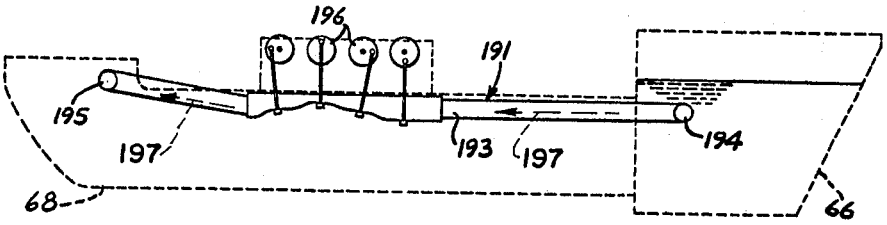
FIG. 3 is a semi-diagrammatic view of a unit for producing continuous washing, and a recirculation unit associated therewith.

Referring again to FIG. 2, the washing action is produced by the cross bars 108 under the flexible tube which are raised by crank means 100 through pitmans 94. They produce a peristaltic action or wave motion, these bars being raised in successive form, forcing the water therethrough from the entrance tank to the exit tank, the water carrying the laundry goods therewith. FIG. 3 represents one form of recirculation means in the form of a similar peristaltic recirculating pump 191, in which a flexible tube 193 has an inlet 194 communicating with the exit tank 66 and an outlet 195 communicating with the entrance end of the flexible tube 68, or with the entrance tank 64. This pump 191 serves as a recirculating pump and is actuated by actuators 196 in the same manner as the actuators 94 in connection with the main pump. Thus the water in the washing operation goes in a first direction i.e., from left to right, FIGS. 2, 3, and the recirculation moves the water in the opposite direction, or to the left as indicated by the arrows 197. In this specific arrangement, as well as the others, a certain portion of the water utilized may be drained by suitable means, and only a portion of the water recirculated, with fresh water replenishing the total supply to maintain a certain proportion of fresh water or new water.

Figure 4:
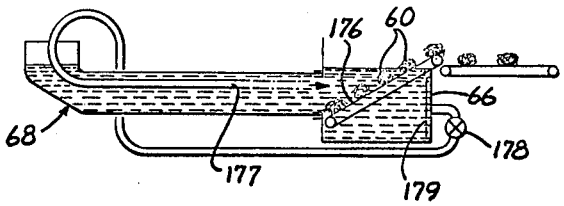
FIG. 4 is a longitudinal sectional view of a component of a continuous washing unit and including a recirculation component.

FIG. 4 shows another form of recirculation means. A recirculating line 177 includes a pump 178, the pump withdrawing water from the exit tank 66 and reintroducing it into the unit through the entrance end of the tube 68, or entrance tank. The line preferably extends a substantial distance through the tube so that its outlet is adjacent the midportion of the tube, or toward the exit end. This arrangement not only provides recirculation of the water, but assists in forcing the water longitudinally through the tube.

Figure 5:
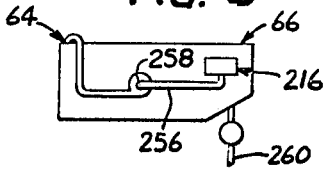
FIG. 5 is a semi-diagrammatic view of another form of recirculation arrangement.
Figure 6:
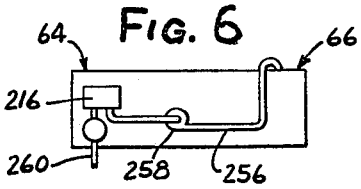
FIG. 6 is a semi-diagrammatic view of a still further form of recirculation arrangement.

FIG. 5 represents another form of recirculation arrangement. In this figure a line 256 receives water from a housing unit 216 connected with the exit end or exit tank 66 and a pump 258 pumps it into the entrance end or entrance tank 64. In this case the water is recirculated in the same direction that the water is moved in the original washing operation. However it may be desired to recirculate the water in the opposite direction, and for this purpose the arrangement of FIG. 6 is effective. In the latter figure, a pipe line 256 leads from a housing unit 216 connected with the entrance tank 64 and includes a pump 258 for pumping the water into the exit tank 66. In both instances, FIGS. 5 and 6, a drain line 260 may be provided for draining or withdrawing to waste any desired portion of the water at the spent end, new water being introduced at the entrance end, to maintain the desired proportion of fresh water.

Figure 7:
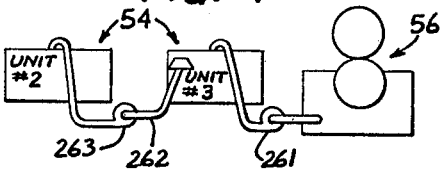
FIG. 7 is a semi-diagrammatic view of another form of recirculation arrangement.
Figure 8:
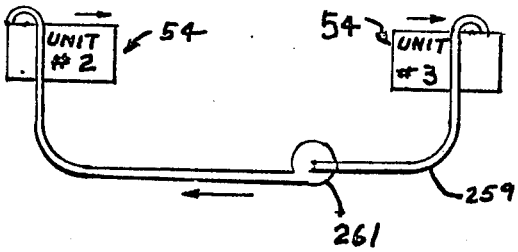
FIG. 8 is a semi-diagrammatic view of still another form of recirculation arrangement.

The invention also encompasses the arrangement where water is withdrawn from one unit and reintroduced into a unit in front of it, and for this purpose the arrangement of FIG. 7 may be utilized. In this figure, unit No. 3 may be a rinsing unit, and unit No. 2 an alkalai unit or soap unit. In such situation the water in the rinsing unit will be more nearly fresh than the water in the unit in front of it and the water in the rinsing unit can therefore be effectively and efficiently utilized in the unit in front of it. In FIG. 7 a line 262 leads from the unit No. 3 and includes a pump 263 which pumps the water into unit No. 2. In this arrangement, the point in one unit where the water is withdrawn and the point in the other unit where the water is reintroduced, may be as desired, but it may also be desired to withdraw the water from the one unit at the exit end and introduce it at the entrance end of the unit in front of it. An arrangement for accomplishing this result is represented in FIG. 8 where a line 259 leads from the exit end of unit No. 3 and includes a pump 261. The line reintroduces the water to the entrance end of unit No. 2. It is further contemplated that the recirculation, when applied to different units, is not limited to adjacent units, but may bypass an adjacent unit and the water reintroduced into a second unit ahead of the unit from which the water is withdrawn.

I claim:

1. Laundry apparatus comprising:

a plurality of laundry units each having entrance and exit ends, said units being arranged serially;

first pump means associated with each of said units for moving liquid with laundry goods through the units from entrance ends to exit ends thereof;

means for transferring wet laundry goods from the exit end of each upstream unit to the entrance end of an adjacent downstream unit; and second pump means for circulating liquid through at least one of said units, the second pump means being separately operative from the first pump means.

2. Laundry apparatus according to claim 1 wherein the second pump means is operative for withdrawing liquid from the exit end of the unit at the exit end of the series and reintroducing it into the entrance end of the unit at the entrance end of the series for recirculating.

3. Laundry apparatus in accordance with claim 1 wherein the second pump means is associated with a selected one of said units and is connected to withdraw liquid from the exit end of said selected unit and reintroduce it for recirculation at the entrance end of said selected unit.

4. Laundry apparatus according to claim 3 wherein the first pump means for moving the liquid includes a peristaltic pump and the means for recirculating the liquid includes a peristaltic pump.

5. Laundry apparatus in accordance with claim 1 wherein the second pump is associated with a selected one of said units and is connected to withdraw liquid from the entrance end of said selected unit and reintroduce it for circulation at the exit end of said selected unit.

6. Laundry apparatus in accordance with claim 1 wherein said second pump means is connected for withdrawing liquid from an exit end of a selected one of said units and reintroduce it through a line extending from a point adjacent the entrance end of said unit to a point approximately midway of said unit and aligned in the direction of flow of liquid through said unit so as to assist in propelling liquid and laundry goods through said unit.

* * * * *